US005999785A

United States Patent [19]

Vackier et al.

[11] Patent Number: 5,999,785

[45] Date of Patent: Dec. 7, 1999

[54] SIMPLEX PRINTING WITH DUPLEX PRINTER

[75] Inventors: Leo Vackier, 's Gravenwezel; Robert Janssens, Geel, both of Belgium

[73] Assignee: Agfa-Gevaert N.V., Mortsel, Belgium

[21] Appl. No.: 08/990,622

[22] Filed: Dec. 15, 1997

[30] Foreign Application Priority Data

Dec. 16, 1996 [EP] European Pat. Off. ..... 96203558

[51] Int. Cl.[6] ..... G03G 15/22

[52] U.S. Cl. ..... 399/306; 399/388; 399/322

[58] Field of Search ..... 399/306, 299, 399/364, 382, 383, 322, 328, 335, 339, 341, 342, 320, 388, 390, 391; 355/24; 430/98, 99, 124

[56] References Cited

U.S. PATENT DOCUMENTS

| | | | |
|---|---|---|---|
| 3,416,863 | 12/1968 | Ralston . | |
| 3,655,184 | 4/1972 | Seelenbinder | 271/64 |
| 3,936,171 | 2/1976 | Brooke . | |
| 4,427,285 | 1/1984 | Stange . | |
| 4,958,828 | 9/1990 | Saito | 271/186 |
| 4,989,036 | 1/1991 | Wilson . | |
| 5,153,653 | 10/1992 | Fuma et al. . | |
| 5,300,984 | 4/1994 | Fuma et al. . | |
| 5,526,107 | 6/1996 | Bronstein | 399/299 |

FOREIGN PATENT DOCUMENTS

| | | |
|---|---|---|
| 0742496 | 11/1996 | European Pat. Off. . |
| 59-165075 | 9/1984 | Japan . |
| 60-188266 | 9/1985 | Japan . |
| 01121877 | 5/1989 | Japan . |
| 01121878 | 5/1989 | Japan . |

*Primary Examiner*—Robert Beatty
*Attorney, Agent, or Firm*—Baker & Botts, L.L.P.

[57] ABSTRACT

In an apparatus and method for producing simplex prints in a single pass duplex printer, two sheets are conveyed in coinciding relationship through a common path during a print cycle. While the sheets are simultaneously conveyed through the common path, a first toner image is formed on one side of one sheet and a second toner image is formed on an opposite side of the other sheet. The toner images are simultaneously fixed on both sheets by a separate fixing station.

15 Claims, 5 Drawing Sheets

SIMPLEX PRINTING WITH DUPLEX PRINTER

DESCRIPTION

1. Field of the Invention

The present invention relates to electrostatographic printing, and more in particular to a method of making black-and-white and colour simplex prints by means of a duplex printer.

2. Description of the Prior Art

Printers and copiers which create duplex output generally fall into one of two categories. In a double pass system, images are transferred to one side of a series of copy sheets; the images are fused and the copy sheets are received in a duplex tray. From the duplex tray they are re-fed to the transfer station to receive images on the other side of the copy sheet, these images also are fused and then the sheets are sent to an output tray.

In a single pass system, a copy sheet is fed to a transfer station to receive an image on one side and then is turned over and fed back to either the same transfer station or to a second transfer station to receive an image on the other side. U.S. Pat. No. 3,672,765 shows an early example of this approach in which two transfer stations and two fusers are used, the first image being fused before the copy sheet is turned over for feeding to the second transfer station.

More recent copiers and printers provide a substantial advantage in the single pass form of duplexing. A first and a second transfer station, or a plurality of such stations, are provided for applying toner images in succession to both sides of a receiver sheet. Sheet transport means is provided which do not disturb the toner images applied to both sides of the sheet, allowing fusing both images simultaneously. This system eliminates significant disadvantages of systems in which the images are separately fused. That is, the two images in such latter system get different amounts of fusing and the second transfer system must operate with a warmed copy sheet which may result in image voids due to wrinkles and the like. Furthermore, different heating may cause different changes of the paper dimensions, and also cause a less reliable paper transport. One example of a single pass sequential duplex printer with one fuser is disclosed in EP-A-96 201 03. Another example of a single pass duplex printer with intermeshing sequential toner image transfer is disclosed in EP-A-0 629 927 A2.

Patent U.S. Pat. No. 3,936,171, published in 1976, discloses a single pass duplex copier, that includes two photoreceptor drums forming a nip at their contact area. On each drum, a latent electrostatic image is produced and subsequently developed. After development, both toner images are transferred simultaneously to the copy substrate in the nip of the drums. No fuser station is disclosed in this application. The copy substrate is cut from one or from two rolls, so that individual sheets arrive at the nip formed by the drums. The presence of two rolls of copy substrate offers the possibility to copy one side only of a document at a double output rate. First, an extra copy of the document must be made. Then, both copies, i.e. the original document and the extra copy, are fed manually back-to-back to the copier. Copy substrate is now fed from the two rolls and is cut, so that two sheets arrive back-to-back at the nip formed by the drums. In the nip, the same image is transferred from the top photoreceptor drum to the top copy substrate and from the bottom drum to the bottom copy substrate. This copier presents several disadvantages. Some disadvantages result from the fact that both drums make contact with each other in a nip. E.g., since both drums are charged, these charges may interfere with each other. Furthermore, no fuser is disclosed in U.S. Pat. No. 3,936,171, whereas transporting two back-to-back copies, each holding a toner image, to a fuser station, and fusing the images, is not obvious.

OBJECT OF THE INVENTION

It is the object of the present invention to provide an improved method for producing simplex prints by means of a single pass duplex printer. This method considerably enlarges the possibilities for use of suchlike apparatus.

STATEMENTS OF THE INVENTION

According to the present invention, a method for producing simplex prints by means of a single pass duplex printer which comprises means for producing toner images on both sides of a receptor support conveyed through the apparatus, and a fuser station for fusing such toner images, is characterised by the steps of:

using two receptor supports during each printing cycle and conveying them in coinciding relationship along a common path through said printer, forming one toner image on one side of one receptor support and another toner image on the opposite side of the other one while both supports are simultaneously conveyed through the printer, thereby to produce two simplex prints, and fusing the toner images on both receptor supports.

The common fusing of two receptor supports in back-to-back relationship does not, in principle, require any adjustment of the fuser used otherwise for the fusing of one support bearing a duplex image.

The inventive method allows to redouble the capacity of a duplex printer used for simplex printing. This extended use of the machine can render the acquisition of a simplex printer superfluous in a number of cases. This economical benefit does not only count for the machine itself, but for the savings in floor space and conditioning energy as well.

According to a suitable embodiment of the invention, the two receptor supports are kept adherent to each other during their common transport through the printer, while the toner images are being formed on their outside surfaces. This is advantageous for the accuracy of transport and of image location on the supports. Such adherence can be obtained through electrostatic attraction. In another way, the receptor supports may be temporarily adhered to each other by the provision of an extra layer on the rearside of the supports, such layer being only very slightly adhesive thereby not to hinder the usual stacking of the sheets, but the mutual contact between two such layers of two coinciding receptor supports providing a sufficient bond for securing the register of both sheets during their processing. According to a still further way, an interleaving foil may be temporarily provided between two coinciding receptor supports for keeping them together by electrostatic attraction, and/or adhesion.

The receptor supports used in the method according to the invention can be sheets as well as webs. The webs can be used in their actual form but can also be cut after fusing to allow stacking of the sheets cut therefrom.

In the case of sheets, it is advantageous to reverse the front-rear-side position of one sheet with respect to that of the other one, so that both sheets can be collected in a common output tray, there being, in principle, no distinction between the image of one sheet and that of a next sheet which has been produced while the sheet was in a reversed position with respect to the first one.

The reversing of the front-rear-side position of such one sheet can suitably occur by conveying such sheet away from the other one and next re-approaching it to the other sheet, its former leading end being now trailing, and vice versa. In practising this technique, the image on the sheet became turned upside down, and therefore it is desirable to print the image on one sheet in a position which is reversed upside down as compared-with that on the other sheet.

The method according to the invention is suitable for producing black-and-white as well as colour and multi-colour images. The term "toner images" as used in the present description encompasses such different types of images.

Two simplex images produced in accordance with the invention can be identic images, as in the case of copying, but can be as well successive images of a series of images forming a section of a writing, and the like.

The images on the respective sheets can be formed in different ways. According to one technique, toner deposition can be direct, e.g. by means of a linear array of micro nozzles image-wise spraying toner on a sheet moving along such nozzles. Control of the rate of deposition can occur by piezo-electric effects, by thermal bubble effects, etc.

However, the images can also be formed by the use of electrostatic attraction effects.

Therefore, according to a suitable embodiment of the invention, the single pass duplex printer comprises toner image transfer stations for transferring toner images resulting from the toner development of electrostatic charge images onto both sides of a sheet conveyed through the apparatus, one toner image being transferred to one side of one sheet and the other toner image being transferred to the opposite side of said other sheet. The mentioned toner images may be formed on the surface of a photoconductor in the form of a drum, a belt or the like.

The present invention also includes an apparatus for carrying out the method according to the invention.

In accordance with the invention, an apparatus for producing simplex prints by means of electrostatography, which comprises sheet holding and sheet dispensing means, toner image transfer stations for transferring toner images resulting from the toner development of electrostatic charge images onto such sheets, and a fuser for fusing such toner images transferred to such sheets, is characterised in that said sheet dispensing means is arranged for dispensing during each printing cycle two sheets from said sheet holding means, that transport means is provided for conveying both sheets through the apparatus in overlying relationship, that said toner image transfer stations are arranged for transferring a toner image to the obverse side of one and to the reverse side of the other sheet, and that said fuser station is arranged for fusing both images while their supports are in back-to-back relationship.

It is clear that as two contiguous simplex prints leave the fuser, their respective images will be located on different sides of the sheets. Therefore, according to a suitable embodiment, an apparatus according to the invention comprises reversing means for reversing each time the upside-down position of one of two paired prints so that the prints can be collected in the output tray of the apparatus, their images being located all on the same sheet side.

The sheet holding means can comprise a sheet platform with associated dispensing means for dispensing each time two sheets at a time, or in succession, but the sheet holding means can also comprise two separate sheet stacks with an associated dispenser for dispensing one sheet from each stack during each printing cycle, and next bringing both sheets together.

BRIEF DESCRIPTION OF THE DRAWINGS

The invention will be described hereinafter by way of example with reference to the accompanying drawings in which.

DETAILED DESCRIPTION OF THE INVENTION

Figure 1:
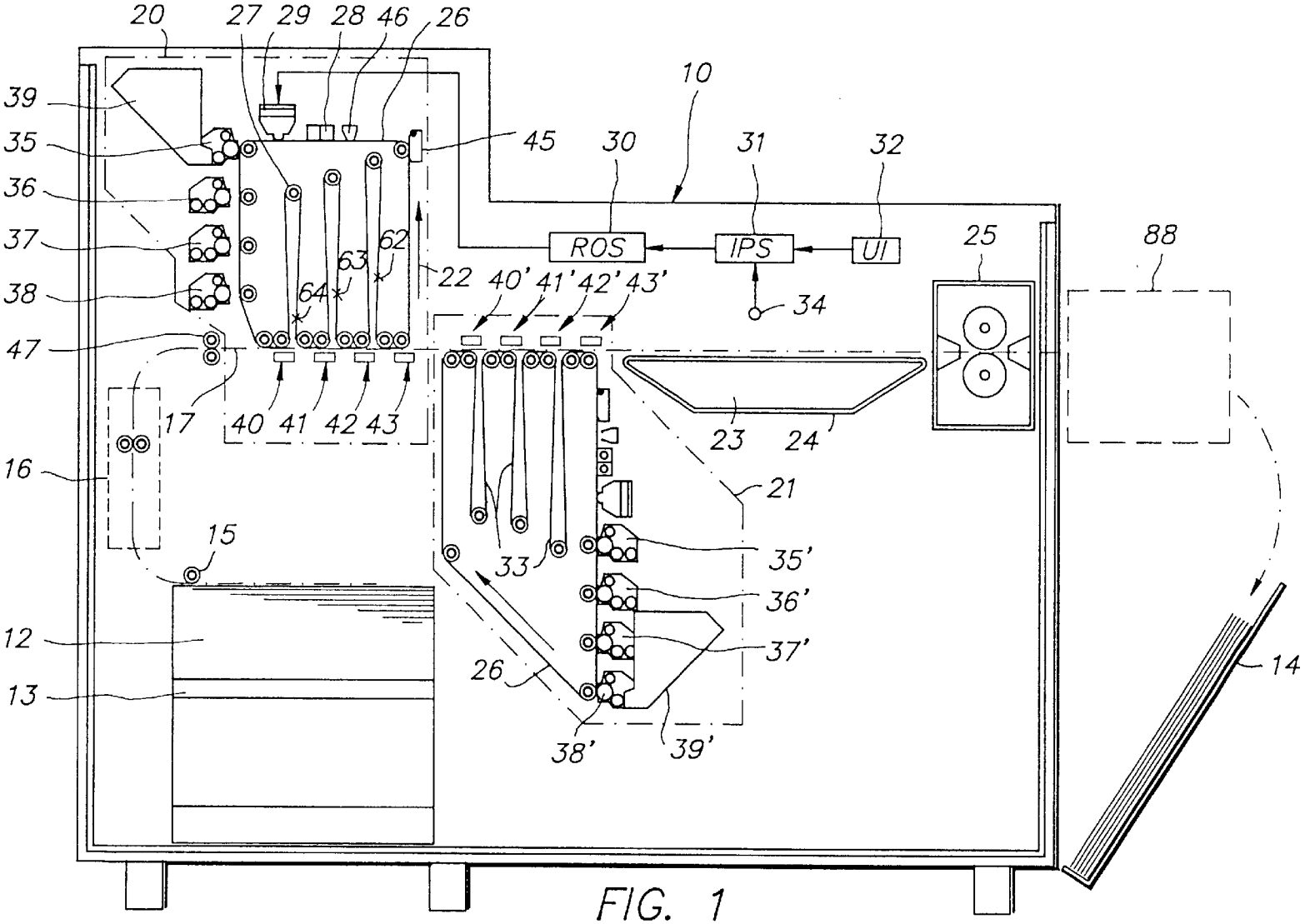
FIG. 1 is a diagrammatic view of one embodiment of an apparatus according to the invention.

FIG. 1 shows a diagrammatic representation of one embodiment of an electrophotographic duplex colour printer, which is used for the printing of simplex images in accordance with the invention.

The printer comprises a lighttight housing 10 which has at its inside a stack 12 of sheets to be printed loaded on a platform 13 the height of which is adjusted in accordance with the size of the stack, and at the outside a platform 14 onto which the printed sheets are received.

Sheets to be printed are removed from stack 12 by a dispensing mechanism 15 which may be any mechanism known in the art such as a friction roller, a friction pad, a suction cup or the like for removing each time the top sheet from stack 12.

The removed sheet is passed through an alignment station 16 which ensures the longitudinal and lateral positioning of the sheet. As the sheet leaves the alignment station, it follows a straight horizontal path 17 up to outlet 18 of the printer. The speed of the sheet, upon entering said path can be determined by roller pair 47.

The following processing stations are located along path 17. A first image forming station 20 indicated in a dash-and-dot line for applying a colour image to the obverse side of the sheet and a second station 21 for applying a colour image to its reverse side. A buffer station 23 with an endless belt 24 for transporting a sheet to fuser station 25 while allowing the speed of the sheet to change because the speed of fuser 25 may be different from the speed of image formation. Fuser station can be any known arrangement in the art, capable of fixing the toner images to their support by contact or radiant heating, contact pressure, etc.

Both image forming stations 20 and 21 being similar to each other, only station 20 will be described in more detail hereinafter.

An endless photoconductor belt 26 is guided over a plurality of idler rollers 27 to follow a path in the direction of arrow 22 to advance successive portions of the photoconductive surface sequentially through the various processing stations disposed about the path of movement thereof. The belt suitably can be a polyethylene terephthalate support which is provided at the outside of its loop with a subbing layer onto which a photoconductive layer has been coated. Means is provided (not shown) for driving the belt at a uniform speed and for controlling its lateral position.

Initially, a portion of photoconductive belt 26 passes through charging station 28. At the charging station, a corona generating device electrostatically charges the belt to a relatively high, substantially uniform potential. Next, the belt is rotated to the exposure station 29, which will expose the photoconductive belt to successively record four latent colour separation images. The exposure station includes a ROS (raster output scanner) 30 with a laser with a rotating polygon mirror block which creates the output printing image by laying out the image in a series of horizontal scan lines, each line having a given number of pixels per inch. However, this station can as well comprise a linear LED array covering the width of the belt for performing the exposure.

The latent images are developed with magenta, cyan, yellow and black developer material, respectively. These developed images are transferred on the print sheet in superimposed registration with one another to form a multicolour image on the sheet. The ROS receives its input signal from IPS (image processing system) 31. This system is the electronic control device which prepares and manages the data inflow to scanner 30. A user interface UI, indicated by reference numeral 32, is in communication with the IPS and enables the operator to control the various operator adjustable functions. IPS 31 receives its signal from input 34. This input can be the output of a RIS (raster input scanner) in case the apparatus is a so-called intelligent copier. In such case, the apparatus contains document illumination lamps, optics, a mechanical scanning drive, and a charge-coupled device. The RIS captures the entire original document and converts it to a series of raster scan lines and measures a set of primary colour densities, i.e. red, green and blue densities at each point of the original document. However, input 34 can as well receive an image signal from an operator operating an image processing station.

After an electrostatic latent image has been recorded on photoconductive belt 26, belt 26 advances this image to the development station. This station includes in the present example four individual developer units 35, 36, 37 and 38.

The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the-brush of developer material into contact with the photoconductive surface. Developer units 35, 36 and 37, respectively, apply toner particles of a specific colour which corresponds to the complement of the specific colour-separated electrostatic latent image recorded on the photoconductive surface. The colour of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 10, while the green areas will be reduced to a voltage level ineffective for development. The charged areas are then made visible by having developer unit 35 apply green absorbing (magenta) toner particles onto the electrostatic latent image recorded on photoconductive belt 26. Similarly, a blue separation is developed by developer unit 36 with blue absorbing (yellow) toner particles, while the red separation is developed by developer unit 37 with red absorbing (cyan) toner particles. Developer unit 38 contains black toner particles and may be used to develop the electrostatic latent image formed from black information or text, or to supplement the colour developments. Each of the developer units is moved into and out of an operative position. In the operative position, the magnetic brush is closely adjacent to the photoconductive belt, whereas in the non-operative position, the magnetic brush is spaced therefrom. During development of each electrostatic latent image only one developer unit is in the operative position, the remaining developer units being in their non-operative one. This ensures that each electrostatic latent image is developed with toner particles of the appropriate colour without intermingling. In FIG. 1, developer unit 35 has been shown in its operative position. Finally, each unit comprises a toner hopper, such as hopper 39 shown for unit 35, for supplying fresh toner to the developer which becomes progressively depleted by the development of the electrostatic charge images.

After their development, the toner images are moved to toner image transfer stations 40, 41, 42 and 43 where they are transferred on a sheet of support material, such as plain paper or a transparent film. At a transfer station, a receptor sheet follows a rectilinear path 17 into contact with photoconductive belt 26. The sheet is advanced in perfect synchronism with the movement of the belt. Advance of the sheet and transfer of a toner image from the belt to the sheet will be described in more detail with reference to FIG. 2 hereinafter. After transfer of the four toner images, the belt follows an upward course and is cleaned in a cleaning station 45 where a rotatable fibrous brush or the like is maintained in contact with the belt 26 to remove residual toner particles remaining after the transfer operation. Thereafter, lamp 46 illuminates the belt to remove any residual charge remaining thereon prior to the start of the next cycle.

The transfer stations 40', 41', 42' and 43' and the developer units 35', 36', 37' and 38' of the image forming station 21 are similar to those of station 20.

Figure 2:
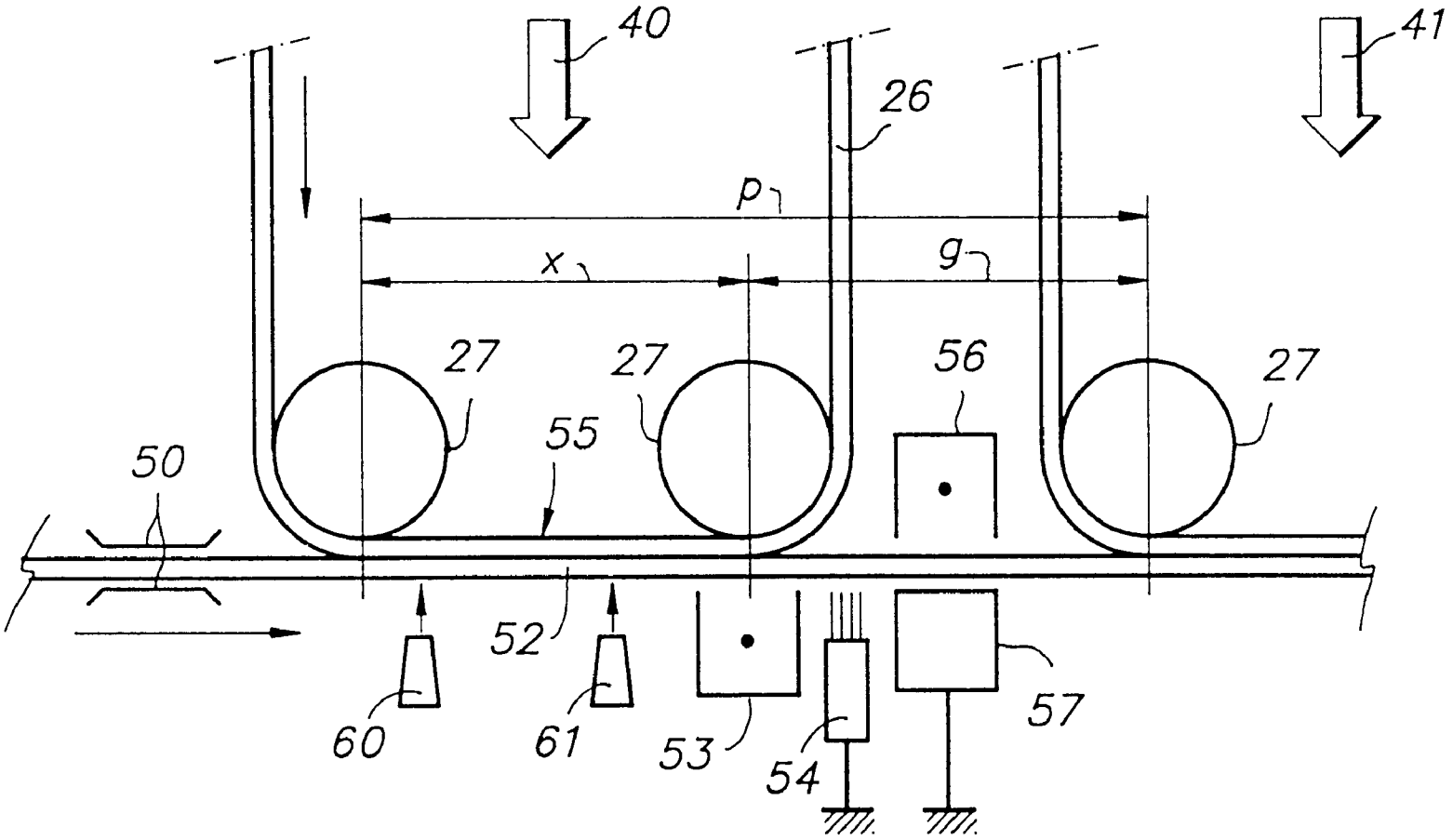
FIG. 2 is a detail of FIG. 1 showing one embodiment of a toner image transfer station.

Referring to FIG. 2, one embodiment of a toner image transfer station 40 of FIG. 1 is shown on an enlarged scale.

Transfer station 40 comprises idler rollers 27 for causing photoconductive belt 26 to follow a short horizontal path 55 as shown. The diameter of rollers 27 amounted to 24 mm in the present example, so that the radius of curvature of the upwardly deflected belt 26 at the right-hand roller amounted to only 12 mm. Sheet 52 is in contact with the belt and moves synchronously therewith because the peripheral speed of sheet driving rollers 47 corresponds exactly with the linear speed of photoconductive belt 26. This synchronous movement may be obtained by different systems known in the art and needs therefore no further explanation. It is also possible to drive the sheet by rollers 47 until the sheet is picked up by the belt, and next opening the rollers.

The sheet is kept in firm contact with the belt as a consequence of electrostatic attraction forces resulting from the belt carrying an electrostatic charge image and from the charging of the sheet by transfer corona 53. Reproducible pick-up of the leading edge of the sheet may be improved if desired by means such as air jets produced by nozzles 60 and 61 biasing the sheet in a direction towards the belt, by guide plates 50 or rigid fingers or flexible guide wires, or the like. The latter, additional expedients may not be required for relatively stiff receptor sheets, e.g. paper sheets having a weight larger than 100 g/sq.m, but may be required for light-weight sheets, which tend to deflect too much from the belt on their travel from one to the next transfer station.

Furthermore, it is clear that the corona station 53 may occasionally be preceded by one or more similar coronas to extend the range of electrostatic attraction, and to improve sheet pick-up.

A first, transfer corona generator 53 is located at a position ahead of the point of separation of the sheet from the belt and sprays ions on the rear side of the sheet so as to charge the sheet to a polarity opposite to that of the charge on the toner image on the photoconductive belt. Thus, the sheet is charged to the proper magnitude and polarity for attracting and transferring the toner image from the photoconductive belt 26 thereto. Suitable DC voltages for this generator are between 3000 and 9000 volts.

A brush-like electrode 54 may serve for discharging the sheet after the toner transfer. This electrode can comprise a plurality of individual, conductive fibres with a diameter down to 10 micrometer that are electrically grounded and thereby are capable of establishing an electric current path with the sheet, even if they remain separated therefrom over a distance between 0.5 and 2 mm approximately.

After the toner image has been transferred to the sheet and the sheet became separated from photoconductive belt 26 a second, conditioning corona generator 56 can spray ions on the front side of the sheet so as to apply a charge on the toner image on the sheet of a polarity equal to that of the charge on the transferred toner image. In this way, the charge on this side of the sheet is increased. Corona generator 56 may be, in principle, any type of corona device suitable for carrying out the desired charging, but we have found that excellent results were obtained with an AC corona operating at a peak-to-peak voltage of 8 to 20 kV at a frequency of 50 to 10000 Hz, an offset to the AC high voltage wave being applied ranging between 0 and 2000 DC volts.

The proper operation of corona 56 requires the opposite side of the sheet to be grounded. This has been shown in the figure as occurring by means of block 57. This block 57 can be a conventional AC or DC, or a combination of AC and DC corona, a grounded plate running parallel to the sheet, an electrically conductive brush such as brush 54, a roller or the like. More details about this and the other transfer stations can be found in our co-pending application EP No. 96 20 2251.3 entitled: "Device for electrostatically transferring toner images".

Horizontal section 55 of photoconductive belt 26 imparts a direction of movement to sheet 52 which is such that the sheet is properly directed towards the next transfer station 41, while unsupportedly bridging the gap between both stations in an almost linear way. The gap g between two successive transfer stations in the present example amounted to 43 mm, i.e. the distance centre-to-centre between the second roller 27 of one station and the first one of the next station, whereas the pitch p which is the centre-to-centre distance between the first roller of the successive transfer stations amounted to 75.791 mm. The supported sheet length x amounted to 32.791 mm, the roller diameter being 24 mm as mentioned already.

It has been shown that the transport of receptor sheet 52 through the air in the gap separating two transfer stations is not impedimental to the accuracy of sheet register with the corresponding section of the photoconductive belt in the next station. In the mentioned way, it is possible to transfer four or even more colour part images in superimposition on the receptor sheet with a register error smaller than 75 micrometer as we have found.

More details about the position of the distinct colour part images on photoconductive belt 26 and the length of an image buffer path between two successive transfer stations can be found in our co-pending application EP No. 96 203 561 entitled: "Electrostatic colour printing apparatus".

The operation of the printer described hereinbefore for the production of a duplex image is as follows.

The green latent image being exposed by station 29 on photoconductive belt 26, this image is progressively developed by magenta toner station 35 being in its operative position as the belt moves therethrough. Upon completion of the exposure of the green image and of occasionally a colour wedge, register marks and the like, the blue image becomes exposed. During the blue exposure, the developed magenta image is transported past inactive stations 36, 37 and 38 while toner transfer stations 40 to 43 still are inoperative too.

As the development of the green latent image is finished, magenta development station 35 is withdrawn to its inoperative position and after the trailing edge of the magenta image has passed yellow development station 36, this station is put in the operative position to start the development of the blue latent image. While the latter portion of the yellow latent image is being developed, the exposure of the red latent image at 29 starts already.

The described processes of imagewise exposure and colour development continue until the four colour separation images have been formed in successive spaced relationship on the photoconductive belt.

A sheet 52 which has been taken from stack 12 and kept in readiness in aligner 16, is then advanced by rollers 47. The electrostatic transfer devices of the transfer stations are energized, and as sheet 52 reaches toner transfer station 40 where at that moment the last-formed toner image, viz. the black-and-white one, is ready to enter the station toner image transfer can start. Thus, the last-formed toner image is the first to become transferred to sheet 52. The leading edge of the firstly formed toner image, viz. the magenta one, takes a position on the belt as indicated by the cross 62 and will thus be transferred last. The leading edges of the other two toner images take positions as indicated approximately by crosses 63 and 64, respectively.

The timing of exposure of the four distinct images, the relative position of these images on the photoconductive belt and the travelling lengths of the path of this belt between the successive transfer stations are such that as paper sheet 52 follows a linear path through these stations, the progressive simultaneous transfer of the distinct toner images to the paper sheet is such that a perfect registering of these images is obtained.

Sheet 52 bearing a colour toner image on its obverse side produced as described hereinbefore, is now passed through image forming station 21 for applying a colour toner image to the reverse side of the sheet. The production of the reverse side part images started in timed relationship to the obverse side ones, so that the positions of the images on both sheet sides correspond with each other. The cross-over of the sheet from station 20 to station 21 does not raise any problem since basically this transfer is the same as the transfer of the sheet from one to the next image transfer station.

The sheet electrostatically bearing the colour images is then received on endless belt 24 of buffer station 23 before entering fuser station 25.

The purpose of buffer 23 is as follows. Fuser station 25 operating to melt the toner images transferred to the sheets in order to affix them, it will be understood that this operation requires a certain minimum time since the temperature of the fuser is subject to an upper limit which must not be exceeded, otherwise the roller lifetime becomes unsatisfactory.

In other words, the speed of fuser station 25 is limited. The speed of the image formation stations 20 and 21, on the other hand, is, in principle, not limited for any particular reason. On the contrary, it is advantageous to use a high speed of image formation and image transfer, since the four colour separations of each colour image are recorded by exposure head 29 in succession, which means that the recording time of one colour image amounts to at least four times the recording time of one part image.

All this results in a relatively high speed of the photoconductive belts, and thus of the synchronously moving sheets, as compared with a maximum usable travelling speed through the fuser station. In the apparatus according to the present embodiment, the speed of the two photoconductive belts amounted to 295 $mm.s^{-1}$, whereas the fusing speed was 100 $mm.s^{-1}$ or less.

Further, it may be desirable to adjust the fusing speed independently from the image processing speed, i.e. the belt speed, for obtaining optimum results. It should be noted that the image processing speed in the imaging stations is constant.

The length of buffer station 23 is sufficient for receiving the largest sheet size to be processed in the apparatus.

Buffer station 23 operating initially at the speed of the photoconductive belts of devices 20 and 21, the speed of this station is reduced to the processing speed of fuser station 25 as the trailing edge of the sheet has left device 21.

Fusing station 25 can be of known construction, and can be arranged for radiation or flash fusing, for fusing by convection and/or by pressure, etc. The fused sheet is finally received on platform 14.

The sheet bearing the fused image is finally received in tray 14.

The use of the apparatus described hereinbefore for the simultaneous production of two simplex prints at a time requires the following modifications.

Figure 3:
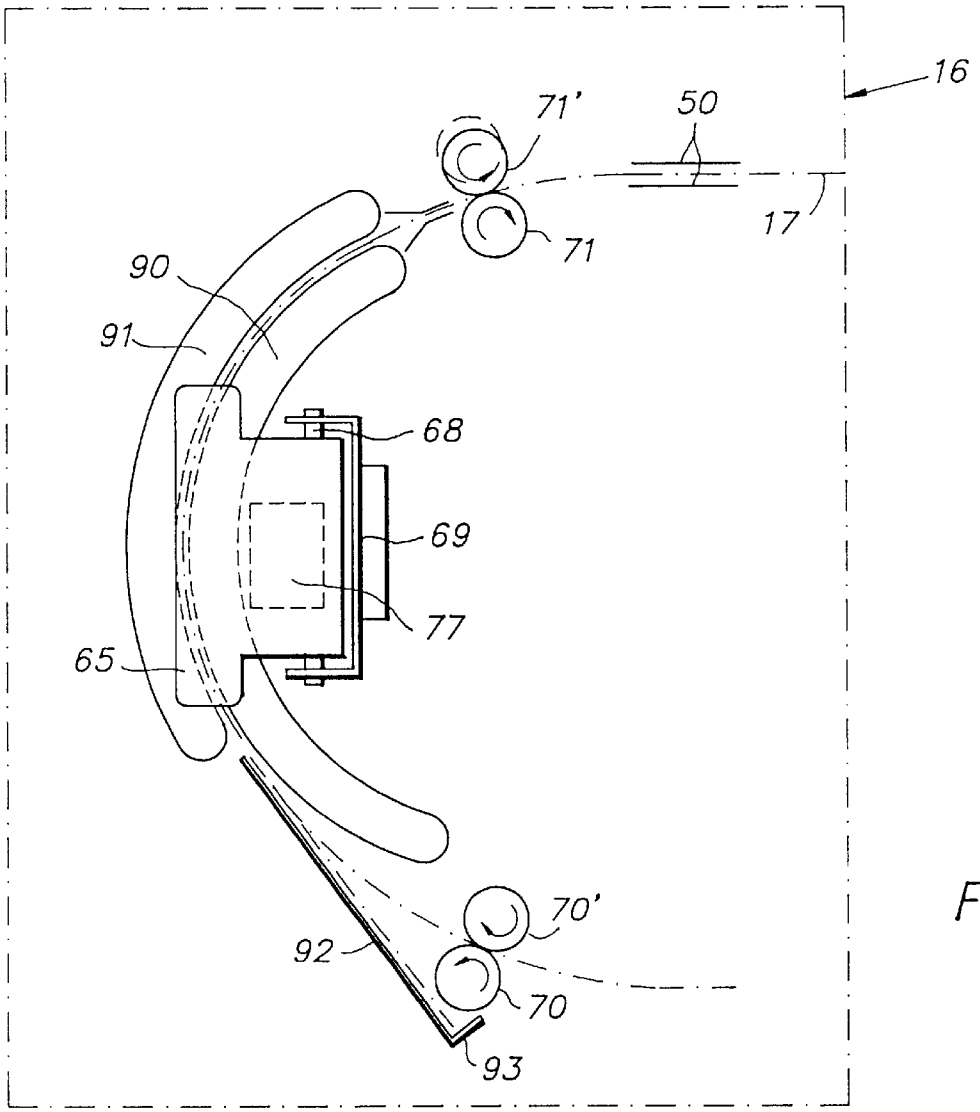
FIG. 3 is a detail of rectangle 16 of FIG. 1, showing one embodiment of a feeder mechanism for longitudinally and transversely aligning two sheets.

First, dispenser mechanism 15 is controlled to feed in succession two sheets from stack 12 into alignment station 16. This station duly registers both sheets. One embodiment of a mechanism for carrying out the required registering is shown in FIG. 3. The mechanism comprises driven inlet rollers 70,70', a driven outlet roller 71 and a co-operating non-driven roller 71' which has a closed position and an open one shown in dashed lines, a number of concentric laterally spaced curved sheet guides 90 and 91, a stationary plate 92 with stop 93 for the longitudinal registering of two sheets, two lateral aligning plates 65 (one only being shown) at opposite lateral sides of the curved sheet path between guides 90, 91 for the lateral registering of the sheets, and an outlet channel 50.

Plates 65 can be metal plates with a T-like shape as shown approximately. One plate can take a stationary position while the other one can be swingeable about a pivot 68 mounted in a stationary bracket 69, and actuated by motor means represented by block 77 in dashed lines, which can be an A.C. electromagnet, a motor with a crank and crank arm, etc. More details about this type of sheet joggler system can be found in our co-pending application EP N° 96 203 559 filed on even day herewith and entitled: "Sheet joggler system".

Second, the apparatus suitably comprises a sheet inverter as shown by block 88 in dashed lines in FIG. 1 for reversing the front-rear side position of one of every two paired simplex prints so that the sheets are collected in tray 14 with their images all on the same side.

Figure 4:
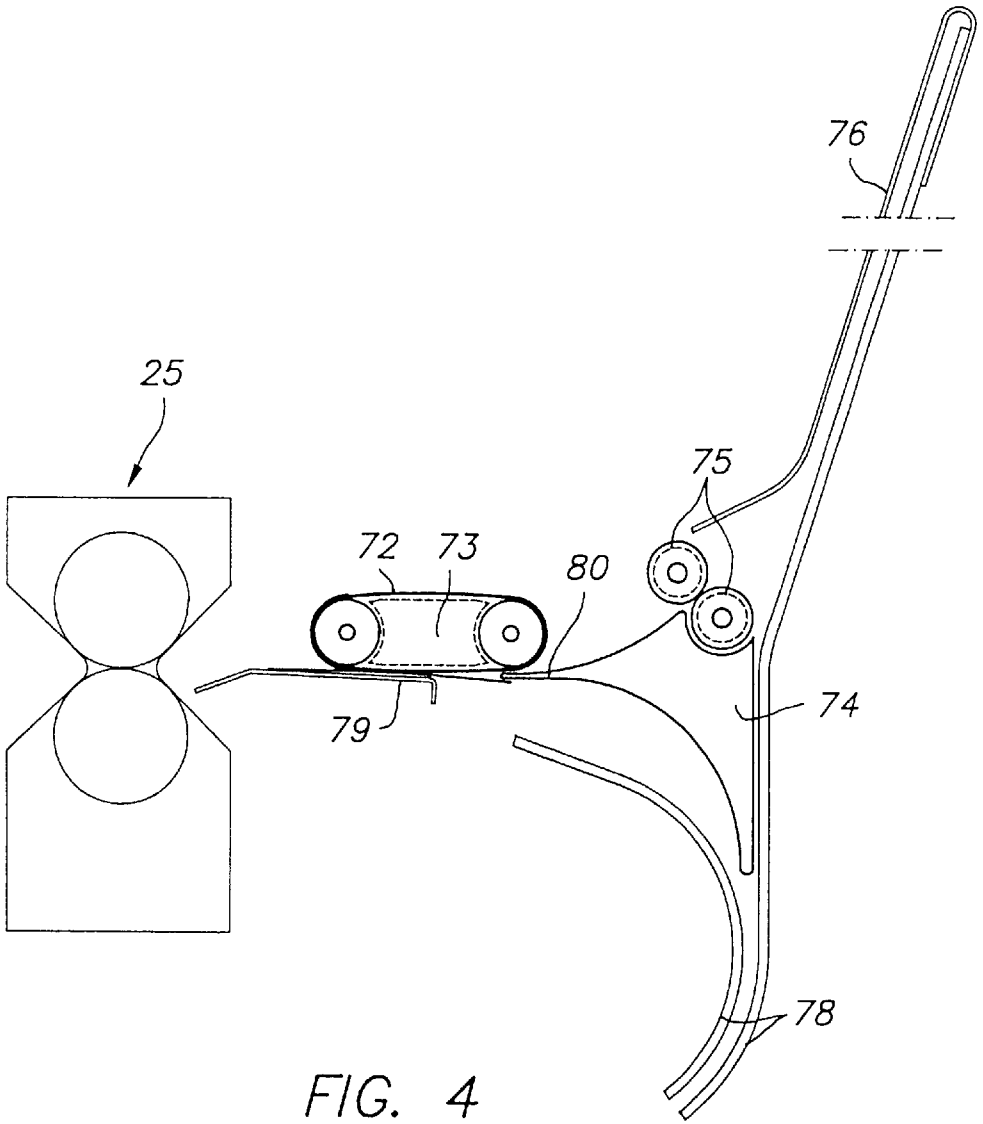
FIG. 4 is one embodiment of a mechanism for separating two sheets printed simultaneously.

One embodiment of such inverter is shown in FIG. 4. It comprises a guide plate 79 slightly sloping downwardly, a pervious, endless belt 72 running about a vacuum box 73, a sheet separator 74, a pressure roller pair 75 which is driveable in forward and rearward direction, a sheet chute 76 and an outlet channel 78.

Finally, IPS 31 is adjusted by the operator through UI 32 in such a way that one of the images on two registered sheets is printed in a reversed top-bottom location. As a matter of fact, the front-rear-side reversing of one sheet with respect to the other of each twin locates the simplex images on the same side of the sheets in output tray 14, it is true, but the top-bottom location of the image of the reversed sheets is opposite to that of the non-reversed sheets. The electronic reversing of one of every two images obviates the described inconvenience.

The operation of the apparatus in accordance with the present invention is as follows.

Dispenser roller is activated to remove two sheets in succession from stack 12, this in response to the appropriate setting of IPS 31. As the first sheet is received in system 16, roller pair 70,70' drives the sheet until its leading end extends through the gap between opened rollers 71,71'.

As the trailing sheet end is no longer engaged by rollers 70,70', the trailing edge of the sheet is deflected by frictional contact with roller 70 in the direction towards plate 92. Then the sheet falls in the opening between roller 70 and plate 92 until it abuts against sheet stop 93.

The second sheet follows the same path and it is likewise led with its trailing edge in contact with stop 93 of plate 92. During the described longitudinal registering plates 65 are operative to laterally align the sheets and this motion contributes to their rapid longitudinal registering. Next roller 71' is closed whereby both sheets are advanced through guide 50 to the first imaging station 20, along path 17. Electrostatic attraction forces produced by the coronas of the different transfer stations 40–43 ensure a firm frictional contact between both sheets so that their registering is maintained after the driving contact with rollers 71,71' is broken.

When the leading end of the sandwich of both sheets enters image forming station 21, image transfer on the lower sheet is started. It will be understood that at this moment image formation on the trailing portion of the upper sheet is still going on. As mentioned already hereinbefore, image formation in station 21 is top-to-bottom reversed as compared with the one in station 20.

The sheet sandwich is transported by belt 24 to fusing station 25. The fused sheets leaving this station are then separated by the separating mechanism shown in FIG. 4 which operates as follows.

Both sheets leaving fusing roller pair 25 are conveyed over guide plate 79. The slanting position of this plate is such that even the stiffest sheet would bend to such an extent that it would pass under finger 80 of sheet separator 74. Vacuum belt 72 keeps the upper sheet upwardly so that this will move over finger 80 whereas the lower sheet is not catched and moves below this finger. The upper sheet becomes gripped by driven roller pair 75 and is fed into chute 76. In the meantime, the lower sheet moves under separator 74 and enters channel 78. The upper sheet is moved upwardly until its trailing end leaves the nip between rollers 75 and is then deflected towards the right-hand side, entering thereby the gap between the right-hand roller and the adjacent wall so that it can fall and enter also channel 78 which leads to tray 14. A driven friction roller may be provided approximately half-way the height of chute 76 to assist the downward movement of the sheet in this chute.

The invention is not limited to the embodiment described hereinbefore.

Sheets to be printed may occasionally be taken from two stacks simultaneously so that registering them can occur faster.

Figure 5:
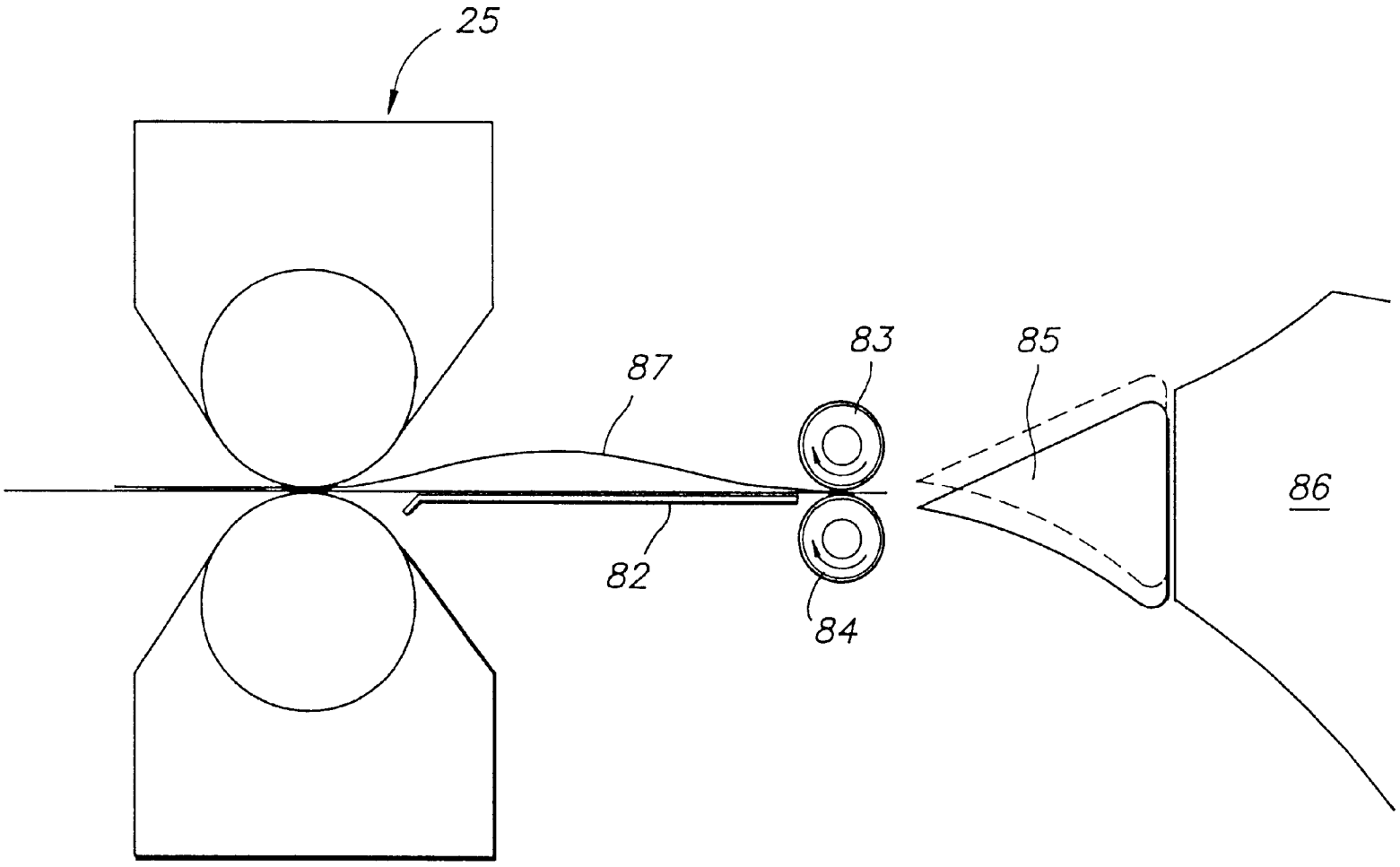
FIG. 5 is another embodiment of a mechanism for separating two sheets printed simultaneously.

Sheets can be separated by other mechanisms than the illustrated one. Another separating mechanism is shown in FIG. 5.

It comprises a horizontal guide plate 82, a pressure roller pair with two individually driveable sheet feeding rollers 83 and 84, a sheet separator comprising a member 85 mounted for translation as shown in broken lines and a stationary member 86.

The operation of the mechanism is as follows. Two sheets leaving fuser 25 in registering relationship are forwarded over plate 82 until their leading ends reach rollers 83, 84. Both rollers rotating first in clockwise direction as shown by the respective arrows, it is clear that the upper sheet will bulge as shown by arrow 87 as it is still further fed by the rollers of the fuser, whereas the lower sheet follows a straight path until it becomes downwardly deflected by member 85 taking the position shown in dashed lines. Shortly after deflection of the leading end of the lower sheet, the direction of rotation of roller 83 is reversed while at the same time element 85 is put in the lower position, shown in drawn lines. The upper sheet now becomes upwardly deflected and can be briefly stored in a magazine or chute as 76 of FIG. 4. Thereafter both sheets can be received in coinciding relationship in an output tray.

Still another separating mechanism is one comprising two opposed suction belts as belt 72 of FIG. 4, for separating the sheets and conveying them in two different directions.

PARTS LIST

10 housing
12 sheet stack
13, 14 platform
15 dispenser
16 aligner
17 sheet path
20, 21 image forming stations
23 buffer station
24 transport belt
25 fuser
26 photoconductive belt
27 idler rollers
28 charging station
29 exposure station
30 ROS
31 IPS
32 UI
34 input
35, 36, 37, 38 developer units
39 hopper
40, 41, 42, 43 image transfer stations
45 cleaning station
46 lamp
47 driving rollers
50 guides
52 sheet
53 corona
54 brush
56 corona
57 grounding
60, 61 air jets
65 lateral registering plate
68 pivot
69 bracket
70, 70' input rollers
71, 71' output rollers
72 pervious belt
73 vacuum box
74 separator
75 driving rollers
76 chute
77 vibration motor
78 outlet
79 slanting guide plate
80 separating edge
82 guide plate
83, 84 separating rollers
85 movable separator
86 fixed separator
87 bulged sheet, and
88 sheet inverter.
90, 91 sheet guides
92 longitudinal registering plate
93 sheet stop
g gap (unsupported sheet length)
p pitch
x supported sheet length

We claim:

1. A method for producing simplex prints by means of a single pass duplex printer which comprises means for producing toner images on both sides of a receptor support conveyed through the apparatus, and a fuser station for fusing such toner images, characterized by the steps of:

using for a printing cycle two receptor supports and conveying them in coinciding relationship along a common path through said printer, forming one toner image on one side of one receptor support and another toner image on the opposite side of the other receptor support while both receptor supports are simultaneously moved through the printer thereby to produce two simplex prints, transporting both receptor supports, both having toner images, to the fuser station, and fixing the toner images on both receptor supports at the fuser station while keeping both receptor supports in mutually coinciding relationship.

2. Method according to claim 1, wherein said printer comprises toner image transfer stations for transferring toner images resulting from the toner development of electrostatic charge images onto both sides of a receptor support conveyed through the apparatus, and wherein said one toner image is transferred to one side of said one receptor support and said other toner image is transferred to the opposite side of said other receptor support.

3. Method according to claim 1, comprising providing measures for keeping said two receptor supports firmly adherent to each other during their common transport through the printer.

4. Method according to claim 3, wherein said measures comprise electrostatically charging said supports.

5. Method according to claim 3, wherein said measures comprise providing said receptor supports at their rear side with a layer showing limited adhesive characteristics, for temporarily adhering them to each other during their processing.

6. Method according to claim 3, comprising providing an additional foil between said two receptor supports for temporarily holding them together during their processing.

7. Method according to claim 1, comprising printing on sheet-like supports, and reversing the front-rear-side position of one support with respect to that of the other one after the fixing of the images, and guiding both supports to a common output tray.

8. Method according to claim 7, comprising reversing said front-rear-side position of one support by conveying said one support away from the other one, and next re-approaching said one to said other support, its former leading end being now trailing and vice versa.

9. Method according to claim 8 comprising printing the image on one support in a position which is turned upside-down with respect to that of the one on the other support.

10. Method according to claim 1, wherein each toner image is a multicolour image composed of superimposed colour separation images.

11. Apparatus for producing simplex prints, which comprises sheet holding and sheet dispensing means, toner image forming stations for forming toner images onto such sheets, and a fuser station for fusing such toner images transferred to such sheets, characterised in that said sheet dispensing means is arranged for dispensing during each printing cycle two sheets from said sheet holding means, that transport means is provided for moving both sheets in overlying relationship through the apparatus, that said toner image forming stations are arranged for forming a toner image to the obverse side of one and to the reverse side of the other sheet, that said fuser station is separate and apart from said toner image forming stations, and that said fuser station is arranged for fusing both images while their supports are in back-to-back relationship.

12. Apparatus according to claim 11, which comprises means for longitudinally and transversely aligning two sheets taken from said sheet holding means.

13. Apparatus according to claim 11, which comprises means for separating both sheets from each other after fusing of their respective images, and for conveying them to a common output tray.

14. Apparatus according to claim 13, which comprises means for reversing the upside-down position of one sheet of each set of two sheets, thereby to locate the sheets with their images all on the same side.

15. Apparatus according to claim 13, wherein said separating means comprises a pair of rollers, means for driving said rollers first in opposed directions so as to forward said sheets, and next for briefly driving them in the equal directions so as to cause a separation of the leading ends of the sheets in their transport direction, and a sheet separator with two sheet deflecting positions, a first one directing the leading sheet towards a first path, and a second one directing the trailing sheet towards a second path separate from the first one.

* * * * *